US011912470B2

(12) United States Patent
Jacob et al.

(10) Patent No.: US 11,912,470 B2
(45) Date of Patent: Feb. 27, 2024

(54) BEVERAGE SYSTEM AND LID WITH MAGNETIC SPRING MECHANISM

(71) Applicant: Brumate, LLC, Denver, CO (US)

(72) Inventors: Dylan M. Jacob, Denver, CO (US); Jordan Westerberg, Denver, CO (US)

(73) Assignee: Brumate, Inc., Denver, CO (US)

( * ) Notice: Subject to any disclaimer, the term of this patent is extended or adjusted under 35 U.S.C. 154(b) by 0 days.

(21) Appl. No.: 17/848,217

(22) Filed: Jun. 23, 2022

(65) Prior Publication Data

US 2023/0415964 A1 Dec. 28, 2023

(51) Int. Cl.
*B65D 47/08* (2006.01)
*B65D 85/72* (2006.01)

(52) U.S. Cl.
CPC ..... *B65D 47/0885* (2013.01); *B65D 85/72* (2013.01); *B65D 2313/04* (2013.01)

(58) Field of Classification Search
CPC .... B65D 43/22; B65D 43/24; B65D 47/0885; B65D 2313/04; B65D 2590/664; A45F 3/16
See application file for complete search history.

(56) References Cited

U.S. PATENT DOCUMENTS 9,919,654 B2 * 3/2018 Gaudig ..... B60R 7/04
2003/0136803 A1 * 7/2003 Kuwano ..... A47J 41/02 222/481.5

* cited by examiner

*Primary Examiner* — Andrew T Kirsch
(74) *Attorney, Agent, or Firm* — Shook, Hardy & Bacon L.L.P.

(57) ABSTRACT

Aspects disclosed herein generally relate to beverage systems. Particularly, beverage systems comprising a lid structure having a pivoting cap with a magnetic spring mechanism are provided. The beverage systems in accordance with aspects herein can further comprise shaker structures for mixing contents and/or infusing a liquid medium with fruits, vegetables, herbs, ice, and the like contained within the beverage systems in accordance with aspects herein.

20 Claims, 12 Drawing Sheets

BEVERAGE SYSTEM AND LID WITH MAGNETIC SPRING MECHANISM

FIELD

Aspects provided herein relate to spill proof and/or leak proof travel beverage accessories such as insulated travel cups, shaker cups, and the like.

BACKGROUND

Travel beverage accessories often include insulated cups and non-insulated cups, double wall cups, or any other suitable beverage container that includes a fitted lid to prevent spilling. The lids can be simple screw on lids, or press-on lids and may not always be leak proof. The lids that include a leak proof mechanisms often include a mechanism that sometimes requires both hands to operate and can thus be cumbersome to use.

SUMMARY

At a high level, a beverage container may include a lid structure coupled to a base structure to define an interior volume for holding and/or dispensing a beverage held within the beverage container. The base structure may be a cup shaped container that may optionally be insulating to keep drinks cold/hot for extended periods of time (e.g., between 4 hours and 48 hours). The lid structure may have a spout portion for dispensing the contents of the beverage container when the lid structure and the base structure are engaged with one another. In order to provide a leak proof beverage container, the spout portion is provided with a pivoting cap for sealing the spout portion and thus, preventing the contents of the beverage container from spilling out when the beverage container is not in its dispensing state (i.e., when traveling, or when not in use).

The pivoting cap configured to engage with the spout portion of the lid structure in accordance to aspects herein, comprises a magnetic spring mechanism that aids the pivoting cap to swing open when unlocked from the spout portion, as will become more apparent in the description with respect to the figures provided below. Once open, the pivoting cap is maintained in its open state by the magnetic spring mechanism regardless of the position or angle of the lid structure with respect to, for example, a horizontal plane running parallel to a ground surface. When the spout portion needs to be closed by engaging the pivoting cap, the pivoting cap can be gently pushed toward the spout portion until locked to the spout portion.

In accordance with some aspects, a beverage system is disclosed where the beverage container may be further provided with a shaker structure configured to break down and mix powdered substances into a liquid medium. For example, protein powders, vitamin powders, supplement powders, and the like mixed into water, juice, milk, or any other suitable liquid medium for easy consumption. The shaker structure may be a colander like or cup like shaped removable piece having a surface with a plurality of openings that are configured to break down any clumps that may form when the powdered substance first comes into contact with the liquid medium, thereby aiding in the thorough mixture and incorporation of the powdered substance into the liquid medium when the beverage container is shaken.

In accordance with further aspects, it is also contemplated that the shaker structure can also be used as an infuser. For example, solid foods like berries, cucumbers, citrus fruits, fresh herbs (e.g. mint leaves, basil leaves, and the like), or any other suitable solid food desired for infusion can be placed within the base structure together with any desired liquid medium so that the liquid medium gets infused with the fragrance and/or taste of the solid food. It is also contemplated that solid ice cubes larger than the plurality of openings of the shaker structure can also be provided within the base structure to keep the liquid medium cold for a longer period of time. Then, when a user tilts the beverage system to consume the liquid medium, the liquid medium can pass through the plurality of openings of the shaker structure while the solid food and/or ice is retained within the base structure. Alternatively, the solid food and/or ice may be retained within the cavity of the cup like or colander like shaped shaker structure such that the liquid medium contained within the base structure can pass through the plurality of openings of the shaker structure and through the contents of the shaker structure as the liquid medium is dispensed from the beverage system.

Aspects herein are generally directed to a lid for a beverage container having a body portion including a spout portion having a spout opening, a threaded engagement section configured to securely engage a base structure of the beverage container, a recess engaging a pivoting cap, and a first cavity for housing a first magnet. The threaded engagement section extending from a body portion of the lid structure. The threading of the threaded engagement section is complementary to a threaded portion provided at an interior wall of the base structure proximal to an opening edge of the base structure. The pivoting cap has a protruding segment that interfaces with the spout opening of the spout portion when the pivoting cap is in a closed position. The pivoting cap further has a pivoting member having a second cavity for housing a second magnet. The pivoting member is configured to pivotably engage the body portion through at the recess of the body portion to position the first magnet and the second magnet in close proximity with each other such that the pivoting cap pivotably moves from the closed position to an open position.

Aspects herein are generally further directed to a beverage container, the beverage container being comprised of a base structure and a lid structure having a magnetic spout closure system. The base structure may be comprised of a double wall plastic structure, or polymer based material structure, or a thermally insulating structure comprised of stainless steel, aluminum, copper, or any other suitable material or combination of materials suitable for insulating the contents of the beverage container from external temperature fluctuations for extended periods of time. The base structure in accordance with aspects herein includes an outer wall and an inner wall. The inner wall of the base structure includes a threaded portion proximal to the opening edge of the base structure. A step edge is provided in the inner wall of the base structure that defines the end of the threaded portion and the start of a non-threaded portion of the inner wall, where the non-threaded portion of the inner wall extends inward toward a relative center of the container further than the internal threaded section of the base structure. The inner wall of may optionally include volume markings configured to signal a volume quantity contained within the base structure as the base structure is filled with a beverage. The volume of the base structure may be sized and shaped to hold between 14 oz. and 18 oz. of a beverage.

Further aspects in accordance with the present disclosure include magnetic spout closure system for a lid for a beverage container. The magnetic spout closure system includes a first magnet positioned in a first cavity of the lid and a pivoting cap configured to be pivotably engaged with the lid. The pivoting cap includes a second magnet provided in a second cavity of a pivoting member of the pivoting cap. The first magnet and the second magnet are in close proximity with one another such that a first magnetic field of the first magnet is influenced by a second magnetic field of the second magnet. In order to act as a magnetic spring mechanism, the first magnet and the second magnet may be physically aligned with each other, however, the magnetic poles of the first magnet and the second magnet may be offset. In other words, the magnetic pole of the first magnet or the second magnet may be rotated with respect to the magnetic pole of the respective second magnet or first magnet, as will become more apparent with respect to the figures.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

An overview of the features, functions and/or configurations of the components depicted in the various figures will now be presented. It should be appreciated that not all of the features of the components of the figures are necessarily described. Some of these non-discussed features, such as various couplers, etc., as well as discussed features are inherent from the figures themselves. Other non-discussed features may be inherent in component geometry and/or configuration.

DETAILED DESCRIPTION

The subject matter of embodiments of the present invention is described with specificity herein to meet statutory requirements. However, the description itself is not intended to limit the scope of this patent. Rather, the inventor(s) have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Figure 1A:
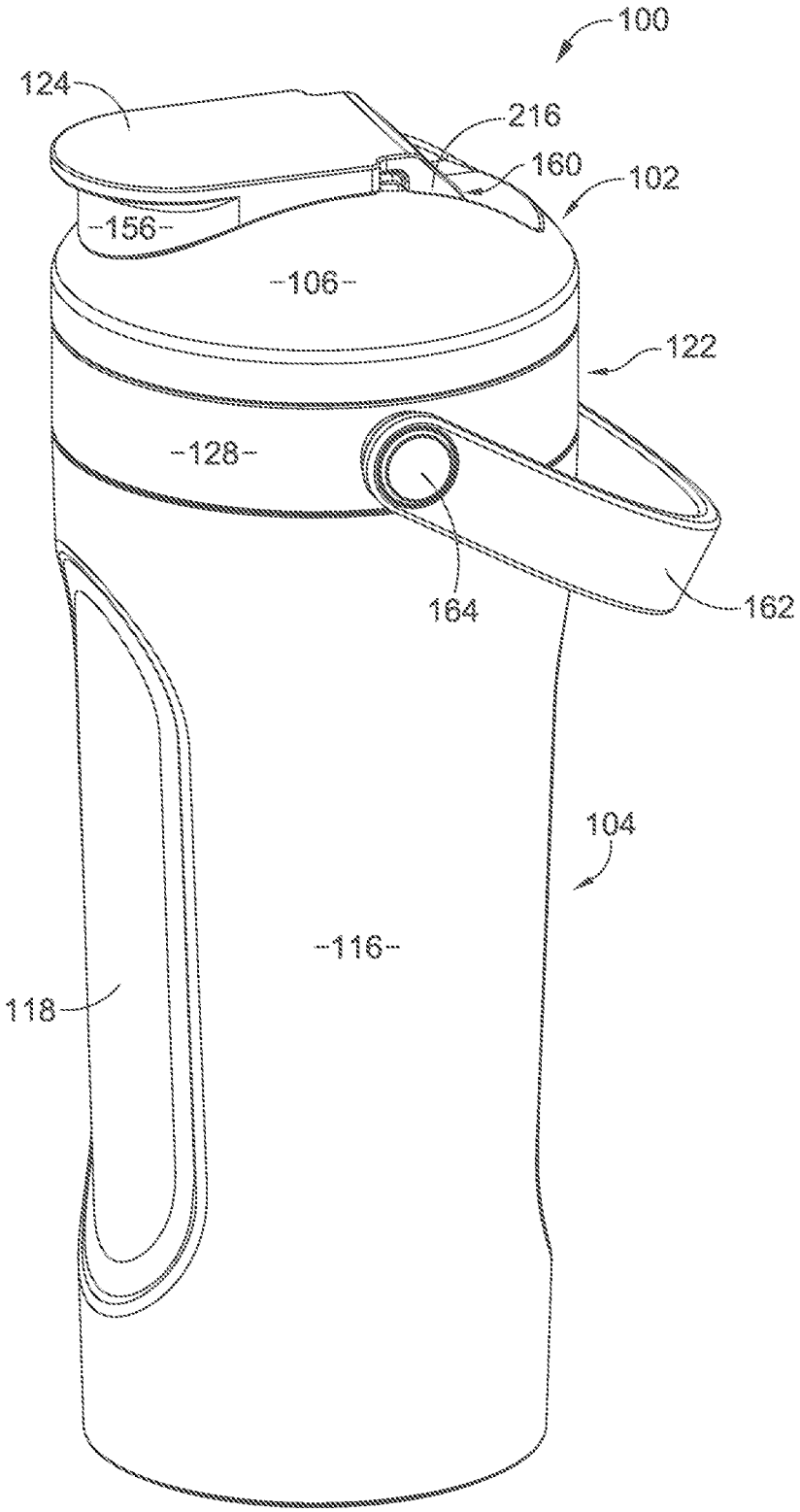
FIG. 1A depicts a perspective view of an assembled beverage system with a lid structure having a pivoting cap in a closed position, in accordance with aspects herein.

At a high level, a beverage system 100 as shown in FIG. 1A is disclosed. The beverage system 100 comprises a lid structure 102 and a base structure 104 as the main components, and a shaker structure 122 that can be optionally integrated in the assembled beverage system 100, as shown in FIG. 1A, or it can be left out, as shown in FIG. 1E, where it is shown how the lid structure 102 can be directly associated with the base structure 104. Continuing with FIG. 1A, the lid structure 102 can be dome shaped, as shown, and can have a body portion 106, a pivoting cap 124 having a hood portion 156 configured to cover a spout 142 (shown in FIG. 1D). The pivoting cap 124 has a pivoting member 216 connected to the body portion 106 of the lid structure 102 at a recess 160 formed in the body portion 106. Further, the base structure 104 is provided in the form of a cup having an outer wall 116 comprising a recessed portion 118. The recessed portion 118 is configured to make the base structure 104 easier to grip, or easier to fit within a user's hand. The volume of the base structure may be sized and shaped to hold between 14 oz. and 18 oz. of a liquid beverage. Furthermore, the shaker structure 122 is configured to fit between the lid structure 102 and the base structure 104 in as assembled state, as shown. When assembled, a first diameter 144 of the body portion 106 is the same size as a second diameter 146 of the shaker structure 122, which in turn is the same as a third diameter 148 of the base structure 104 to provide a smooth transition between the body portion 106, the shaker structure 122, and the base structure 104 when these components are assembled together.

Figure 1B:
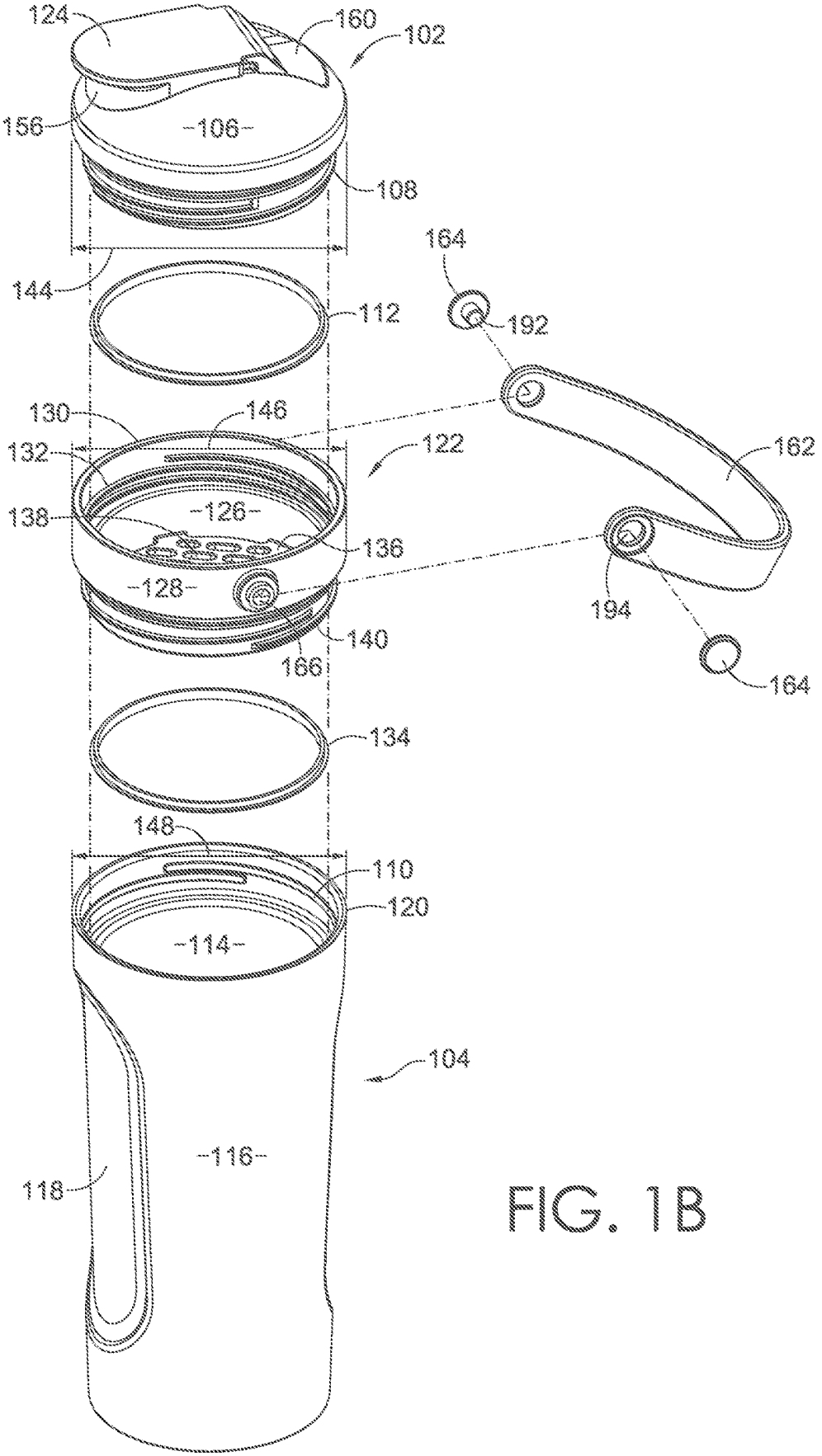
FIG. 1B depicts a perspective view of the beverage system shown in FIG. 1A in a disassembled state, in accordance with aspects herein.

Moving on to FIG. 1B, a disassembled view of the beverage system 100 shown in FIG. 1A, is provided. In accordance with aspects herein, the base structure 104 comprises an inner wall 114 and an outer wall 116. An inner diameter of the inner wall 114 is generally smaller than the third diameter 148 of the outer wall 116, thereby providing a thickness to the base structure 104 between the inner wall 114 and the outer wall 116. The thickness may aid in providing insulation properties to the base structure 104 to prevent rapid cooling, rapid warming and/or sweating when containing cold or iced liquid beverages. Further, the inner wall 114 of the base structure 104 comprises a first threaded portion 110 proximate an opening edge 120 configured to engage with the first threaded engagement section 108 of the lid structure 102 or the second threaded engagement section 140 of the shaker structure 122. Further, in order to improve gripping and/or gripping comfort, the base structure 104 may optionally, further comprise one or more recessed portion(s) 118 on the outer wall 116.

As further shown in FIG. 1B the first threaded engagement section 108 of the lid structure 102 continuously extends from the body portion 106 of the lid structure 102 around an entire circumference of the lid structure 102, where the first threaded engagement section 108 is offset or recessed from the circumference of the body portion 102 having the first diameter 144 of the lid structure 102 so that the first threaded engagement section 108 can be fitted complementarily within the first threaded portion 110 of the base structure 104 or the second threaded engagement section 132 of the shaker structure 122 if the shaker structure is in use. In accordance with aspects herein, the body portion 106 and the first threaded engagement section 108 of the lid structure 102 are configured as one continuous piece, however, it is also contemplated that the engagement threaded section and the body portion 106 can be formed of two or more pieces that are joined together. In accordance with further aspects disclosed herein, the lid structure 102 comprises a first recess between the body portion 106 and the first threaded engagement section 108 configured to fit a first gasket 112. The first gasket 112 is configured to provide a seal between the lid structure 102 and the base structure 104 or the shaker structure 122 when the lid structure 102 and the base structure 104 or the lid structure 102 and the base structure 104 are engaged with each other. Similarly, the shaker structure 122 also comprises a second recess between the body portion 128 and the second threaded engagement section 140 configured to fit a second gasket 134 to provide a seal between the shaker structure 122 and the base structure 104 when the lid structure 102 is engaged with the base structure 104. The shaker structure 122 may also be provided with a strap 162 that can be pivotably connected to the shaker structure 122 via a pair of snap type connections, with one connection located opposite the other connection on the body portion 128 of the shaker structure 122, where a first snap portion 164 is configured to snap into a second snap portion 166 with a peg piece 192 of the first snap portion is configured to extend through an aperture 194 of the strap 162. The length of the strap 162 may be long enough to extend over the lid structure 102 with sufficient clearance for a user's hand or user's fingers to fit between the lid structure 102 and the strap 162, including at a peak of the lid structure 102 when the lid structure 102 is dome shaped. This configuration allows beverage system to be easily carried and portable by the user. In other words, the strap 162 is configured to aid the user in carrying the beverage system 100 from the strap 162 rather than having to grip and hold the base structure 104, which can be cumbersome and/or tiring to do for extended periods of time. Further, the pivoting nature of the strap 162 allows for the strap to be pivoted away from the lid structure 102 to provide unobstructed access and range of motion to the pivoting cap 124 of the lid structure 102 when necessary, as will be more apparent with respect to FIGS. 1C and 1D.

Figure 1C:
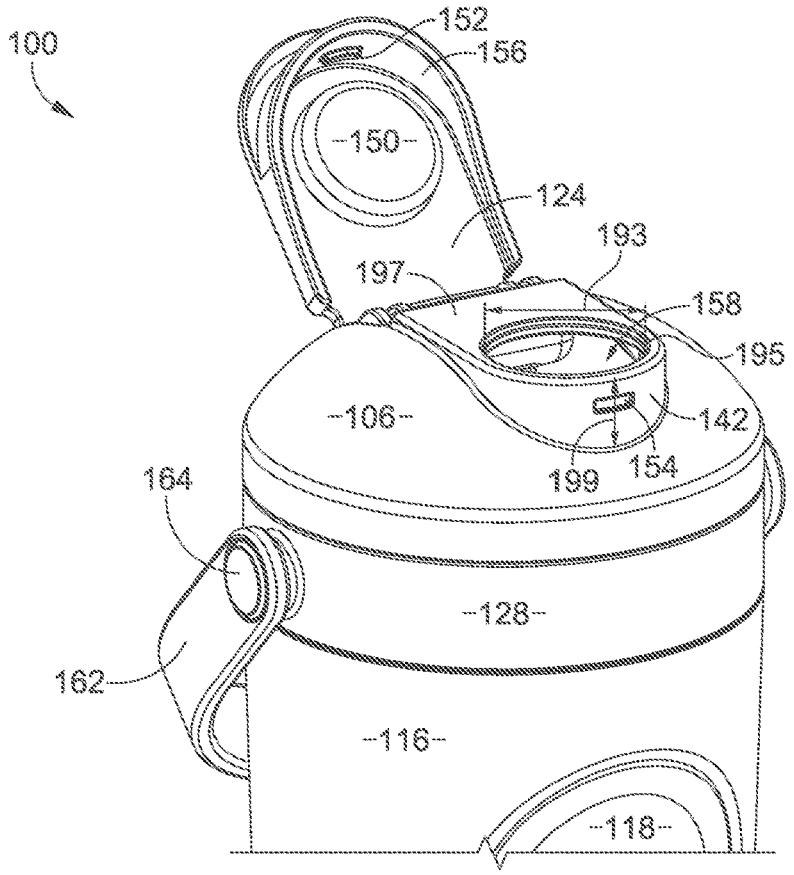
FIG. 1C depicts a close-up perspective view of the lid structure of the beverage system in FIG. 1A, when the pivoting cap of the lid structure is in an open position, in accordance with aspects herein.
Figure 1D:
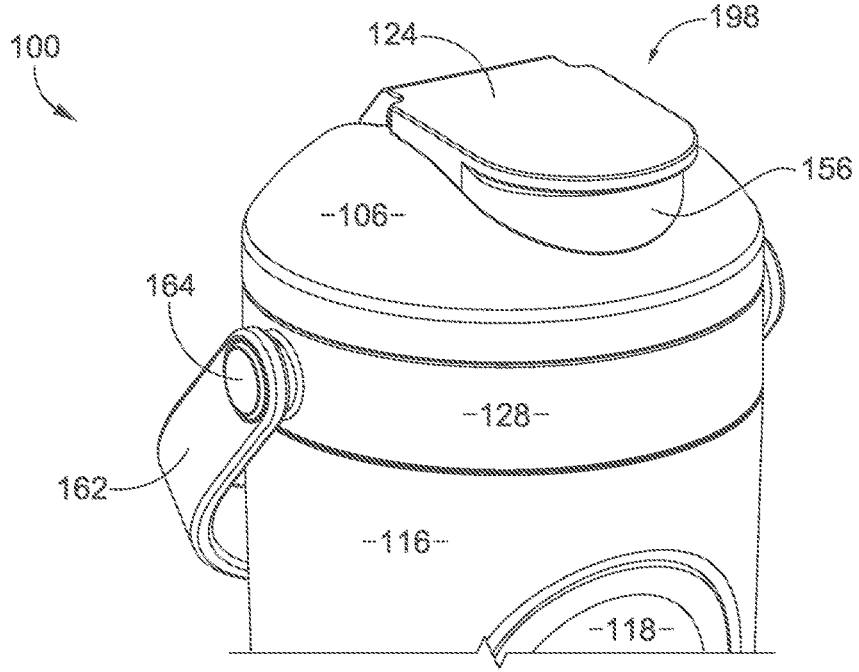
FIG. 1D depicts a close-up perspective view of the lid structure shown in FIG. 1C having the pivoting cap in the closed position, in accordance with aspects herein.
Figure 1E:
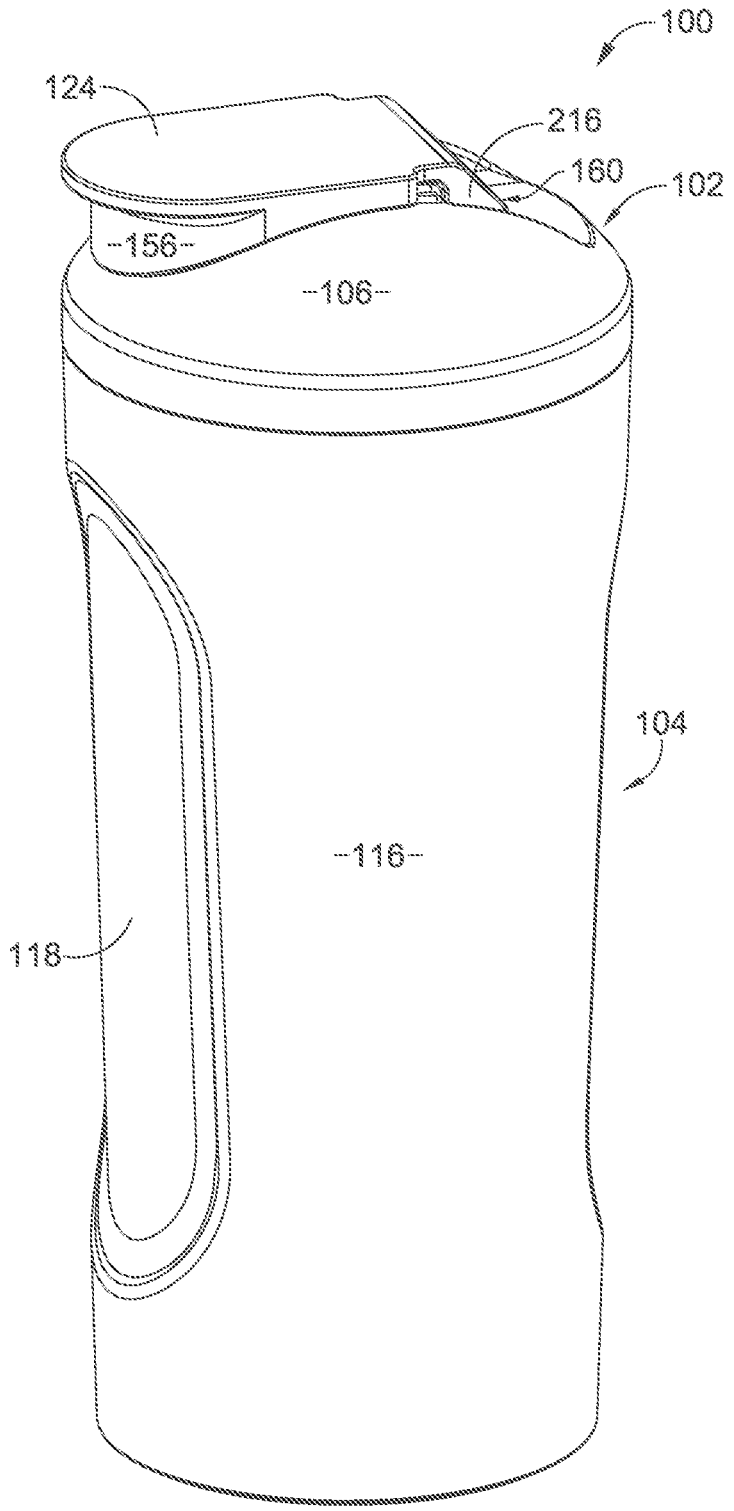
FIG. 1E depicts a perspective view of the beverage system shown in FIG. 1A without a shaker structure, where the lids structure is directly associated with the base structure, in accordance with aspects herein.

FIG. 1C is a close up view of the lid structure 102 in an open position 196. As shown, the lid structure comprises a spout 142 having an opening 158 defined by a perimeter edge 195 through which the contents of the beverage system 100 can be dispensed. As shown, the lid structure may be dome shaped, which would aid in the contents of the beverage system 100 to be stirred and reincorporated into a liquid medium when, for example, the shaker structure 122 is used for shaking, mixing, and/or blending beverages as desired, such as for example, protein drinks, shakes, smoothies, dressings, sauces, etc. to be created and/or stored within or dispensed from the container. Advantageously, the lid structure 102 and base structure 104 may be reusable and refillable, which may allow the lid structure 102 and base structure 104 to be used for many different purposes over an extended period of time. When the lid structure 102 is dome shaped, the spout 142 is configured to extend from the body portion 106 such that the perimeter edge 195 defining the opening 158 is a varying height 199 above the body portion 106 such that the perimeter edge 195 sits at the same level as the peak 197 of the lid structure 102, for example. The opening 158 of the spout 142 is sized to comfortably dispense the contents of the beverage system 100 into the mouth of a user. For example, a diameter 193 of the opening 158 may be sized between and including 2.0 cm and 4.0 cm, for example, between 2.5 cm and 3.5 cm, or between 2.5 cm and 3 cm, or any other suitable value between and including 2.0 cm and 4.0 cm. Further, the spout 142 includes a recess 154 configured to engage a tab 152 located at an interior surface of a hood portion 156 of the pivoting cap 124. The hood portion 156 is configured to envelope and protect the spout 142 from external exposure when the pivoting cap 124 is locked to the spout 142 via the tab 152 and recess 154, as shown in the close up view of the lid structure 102 in a closed position 198 provided in FIG. 1D. Further, the pivoting cap 124 comprises a rubber gasket 150 configured to seal the opening 158 when the pivoting cap 124 is in the closed position 198.

Figure 2:
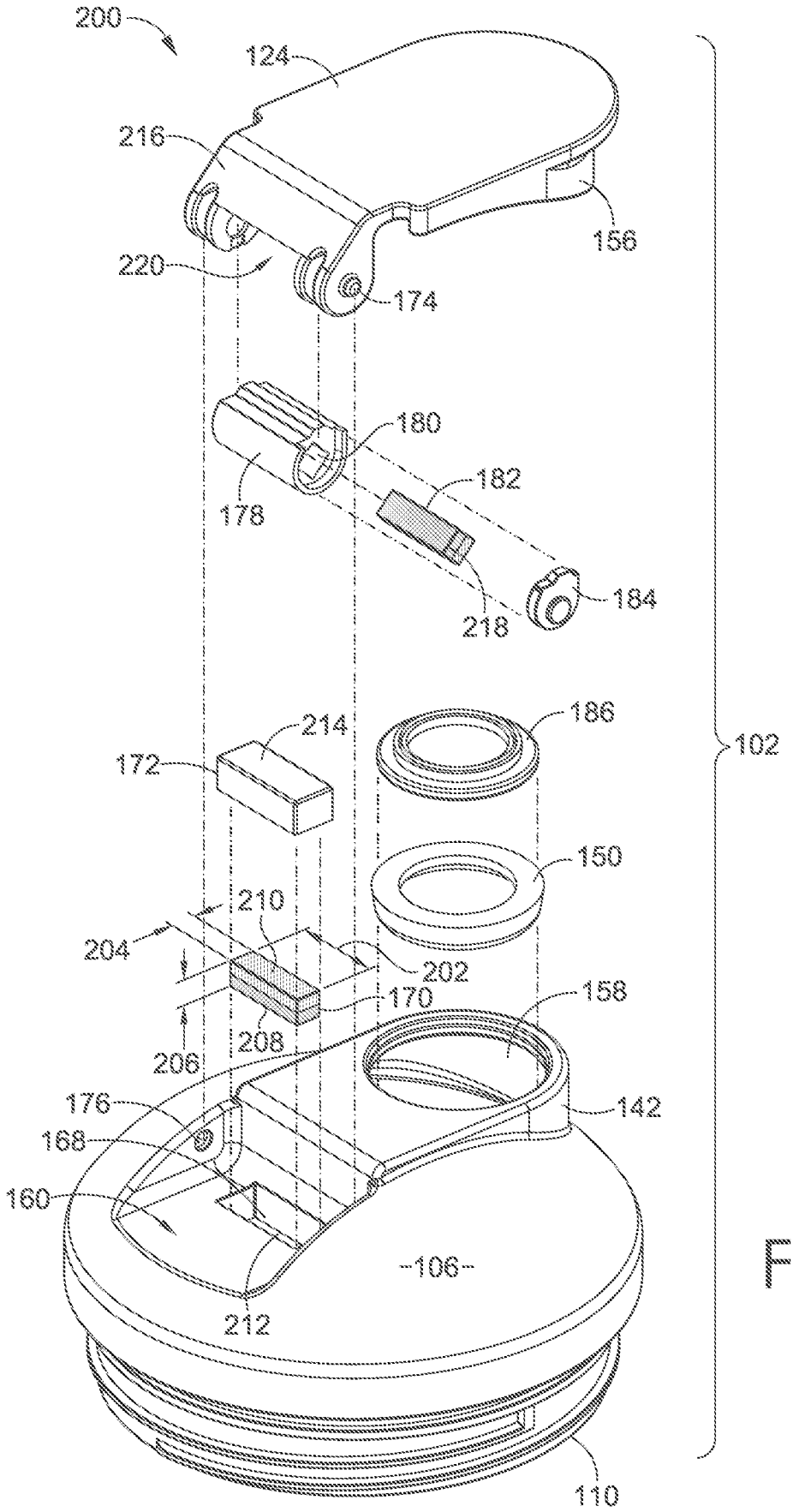
FIG. 2 depicts a perspective view of the lid structure shown in FIGS. 1C and 1D in a disassembled state, in accordance with aspects herein.
Figure 3A:
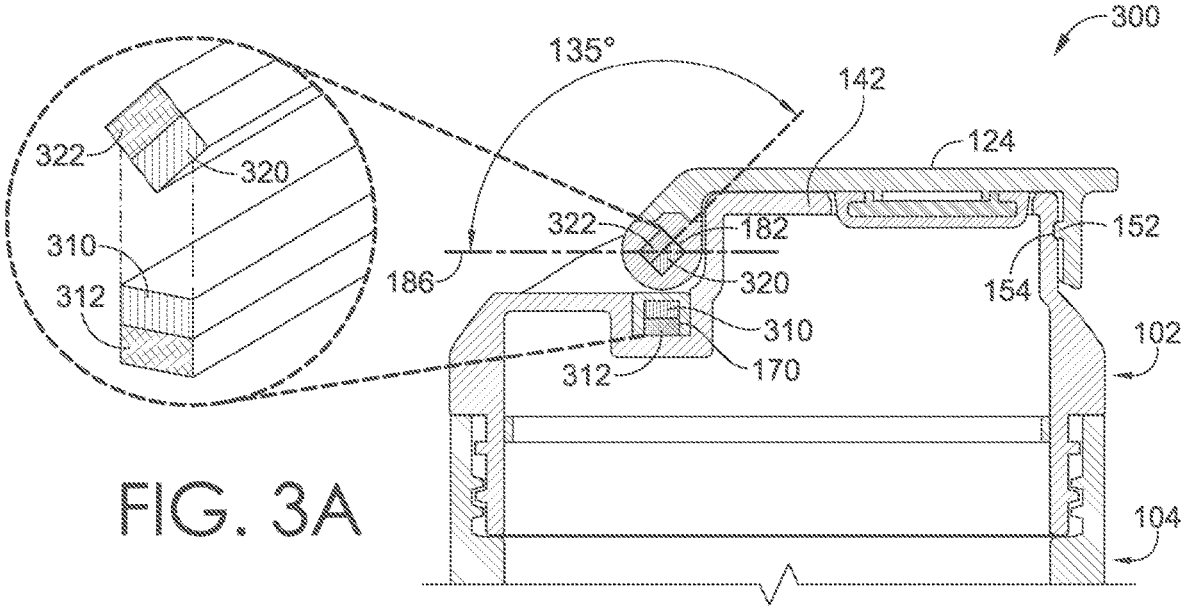
FIG. 3A depicts a cross-sectional view of the lid structure shown in FIG. 1D having the pivoting cap in the closed position, in accordance with aspects herein.

FIG. 2 in particular shows a deconstructed back side view 200 of the lid structure 102. As shown, the lid structure 102 comprises different components including a first magnet 170 housed within a cavity 168 provided within a recess 160 of the body portion 106. The first magnet 170 as shown, can be shaped as a rectangular prism having a length 202, a width 204, and a height 206, with the length 202 being generally longer than both the width 204 and the height 206. The first magnet 170 can be positioned within the cavity 168 of the body portion 106 of the lid structure 102 so that the poles of the magnet are stacked horizontally, or in other words, stacked along the height direction rather than the length direction such that a first surface 208 of the first magnet 170 having a positive/negative pole is in contact with a floor 212 of the cavity 168, and a second surface 210 of the first magnet 170 having the opposite pole is in contact with an interior side of the surface 214 of the cover 172, which is configured to completely enclose and secure the first magnet 170 within the cavity 168 of the body portion 106 of the lid structure 102. Further, the pivoting cap 124 has a pivoting member 216 configured to be in alignment with the cavity 168. The pivot member is composed of a pivoting magnet housing member 178 having a rounded profile. The pivoting magnet housing member 178 has a magnet housing cavity 180 configured to house a second magnet 182 that may have the same size and pole configuration as the first magnet 170. However, the magnet housing cavity 180 is configured to house the second magnet 182 in a rotated configuration with respect to the first magnet 170, when the pivoting cap 124 is in the closed position 198. In other words, as shown in FIG. 3A, the second magnet 182 is rotated 135° with respect to the first magnet 170 such that an edge 218 of the second magnet 182 is configured to be aligned with and face the second surface 210 of the of the first magnet 170. The second magnet 182 can be secured within the magnet housing cavity 180 by cover 184. Then, the pivoting magnet housing member 178 can be secured to slot 220 to the pivoting member 216 of the pivoting cap 124. Then the pivoting member 216 of the pivoting cap 124 can be pivotably secured to the body portion 106 of the lid structure 102 by fitting protruding members 174 of the pivoting member 216 to recessed portions 176 formed in the body portion 106 proximate the recess 160 where the first magnet 170 is housed.

Moving on to FIGS. 3A to 3D, where cross-sectional views of the lid structure 102 are shown. Both the first magnet 170 and the second magnet, are comprised of adjoining magnetic pole segments having opposite polarities, respectively. For ease of description, the first magnet 170 will be described by designating the positive and negative magnetic poles as being negative magnetic pole segment 312 stacked over positive magnetic pole segment 310, however, it is contemplated that the positioning of the magnetic poles can be reversed without departing from aspects herein. Thus, as shown, the first magnet 170 and the second magnet 182 are aligned and located in close proximity to each other such that the magnetic force field of the first magnet 170 influences the magnetic force field of the second magnet 182, as will be described in further detail with respect to FIGS. 4A to 4C. Further, the configuration of the first magnet 170 will be designated as a starting position in accordance with aspects herein.

Continuing with FIG. 3A, a cross-sectional view 300 of the lid structure 102 with the pivoting cap 124 being in the closed position 198 where the tab 152 of the pivoting cap 124 is locked within the recess 154 of the spout 142, is provided. As further shown in FIG. 3A, in the closed position 198, the second magnet 182 located within the pivoting member 216 of the pivoting cap 124, is rotated 135° from the starting position based on axis 186 representing 0° of rotation (configuration of the first magnet 170) such that the positive magnetic pole segment 310 of the first magnet 170 is partially facing the positive magnetic pole segment 320 of the second magnet 182 to a greater extent than the positive magnetic pole segment 310 of the first magnet 170 is facing the negative magnetic pole segment 322 of the second magnet 182. Thus, as shown in the magnetic force field representation 400 shown in FIG. 4A, the repelling forces created by the positive magnetic pole segment 310 and positive magnetic pole segment 320, and the partial attractive forces created by the positive magnetic pole segment 310 and the negative magnetic pole segment 322, force the pivoting member 216 of the pivoting cap 124 to rotate when the pivoting cap 124 is unlocked to move towards the open position 196. The unlocking can be achieved by the user exerting a certain amount of force on the pivoting cap 124 sufficient to dislodge the tab 152 of the hood portion 156 from the recess 154 of the spout 142. In other words, the first magnet 170 and the second magnet 182 create a magnetic spring mechanism that automatically (without user intervention) rotates the pivoting member 216 of the pivoting cap 124. Although 135° rotation from the starting position is depicted and described, it is contemplated that the rotation may be anywhere between 100° and 180° from the starting position, without departing from aspects herein.

Figure 3B:
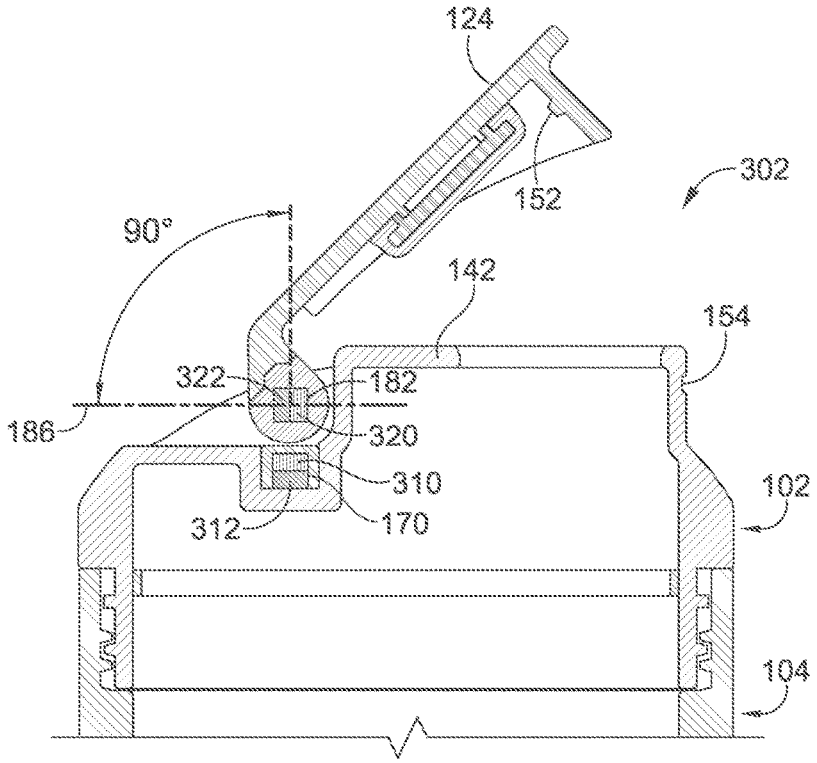
FIG. 3B and FIG. 3C depict cross-sectional views of the lid structure at intermediate positions as the pivoting cap of the lid structure is moved from the closed position to the open position, in accordance with aspects herein.
Figure 4C:
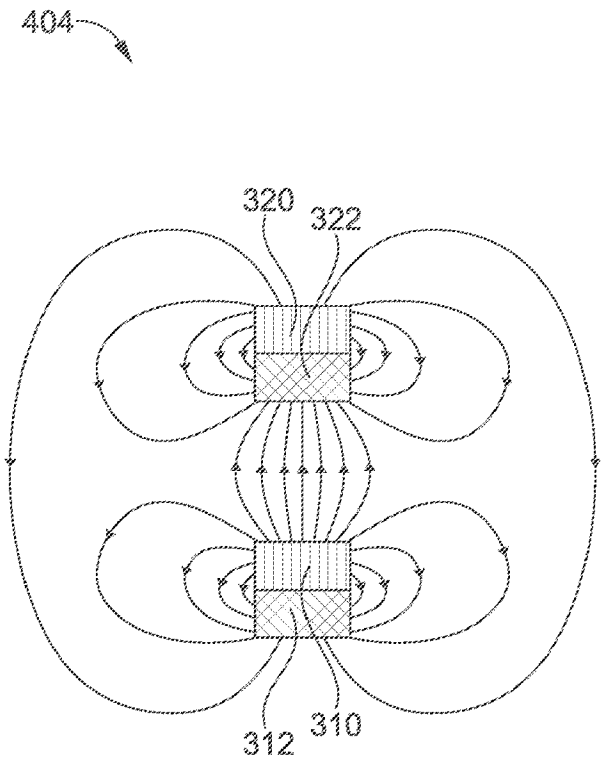
FIG. 4C depicts a magnetic force filed created by magnets in the lid structure when the pivoting cap is in the open position shown in FIG. 3D, in accordance with aspects herein.
Figure 4B:
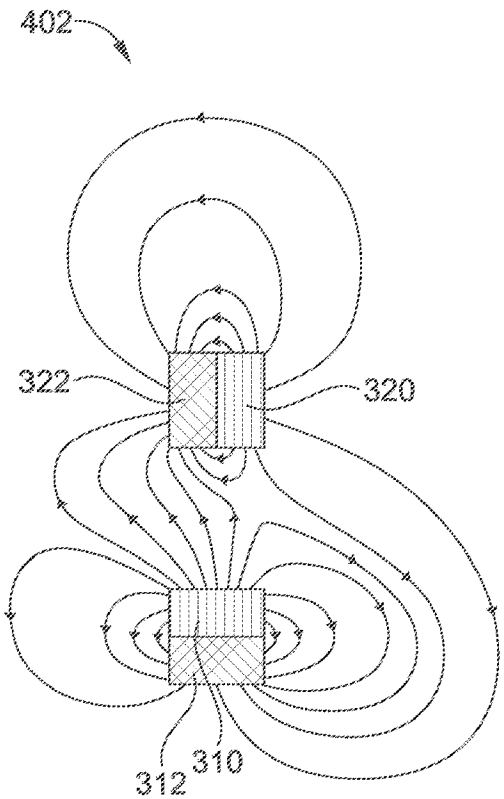
FIG. 4B depicts a magnetic force filed created by magnets in the lid structure when the pivoting cap is in the intermediate position shown in FIG. 3B.
Figure 4A:
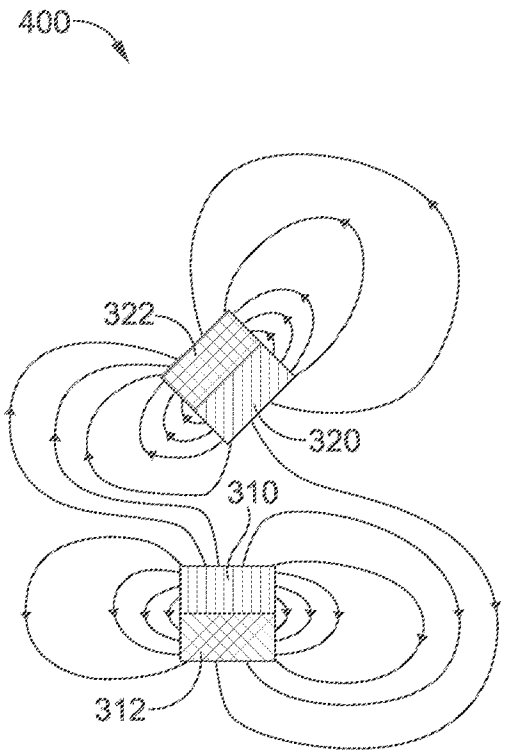
FIG. 4A depicts a magnetic force filed created by magnets in the lid structure when the pivoting cap is in the closed position, in accordance with aspects herein.

FIG. 3B shows a cross-sectional view 302 of the lid structure 102 with the pivoting cap 124 being in an intermediate position as the pivoting member 216 of the pivoting cap 124 begins to rotate. Particularly, FIG. 3B shows a position of the second magnet 182 where the second magnet 182 is rotated 90° from the initial position (configuration of the first magnet 170). At this point, the positive magnetic pole segment 320 and the negative magnetic pole segment 322 of the second magnet 182 equally face the positive magnetic pole segment 310 of the first magnet 170, and thus, the attraction forces between the negative magnetic pole segment 322 of the second magnet 182 and the positive magnetic pole segment 310 of the first magnet 170 are increased with respect to FIG. 3A, as shown in the magnetic force field representation 402 shown in FIG. 4B.

Figure 3C:
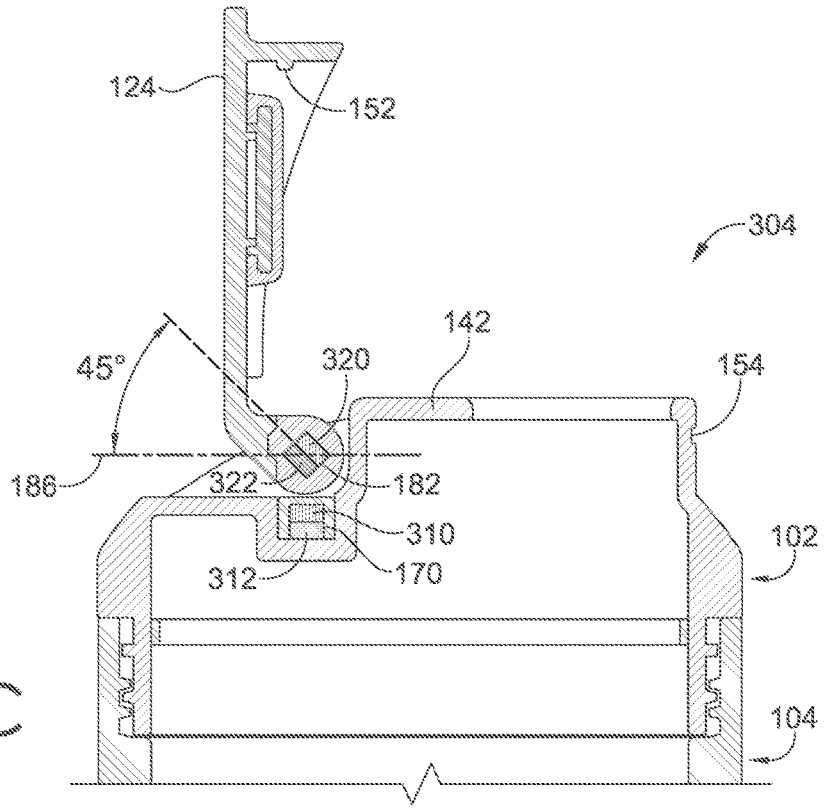

Moving on to FIG. 3C, a cross-sectional view 304 of the lid structure 102 with the pivoting cap 124 being in a second intermediate position as the pivoting member 216 of the pivoting cap 124 begins to rotate, is shown. Particularly, FIG. 3C shows a position of the second magnet 182 where the second magnet 182 is rotated 45° from the initial position (configuration of the first magnet 170). At this point, the attraction forces between negative magnetic pole segment 322 of the second magnet 182 and the positive magnetic pole segment 310 of the first magnet 170 are further increased from the position shown in FIG. 3B, such that the positive magnetic pole segment 310 of the first magnet 170 is facing the negative magnetic pole segment 322 of the second magnet 182 to a greater extent than the partial positon shown in FIG. 3B, further increasing the attraction forces between the negative magnetic pole segment 322 of the second magnet 182 and the positive magnetic pole segment 310 of the first magnet 170.

Figure 3D:
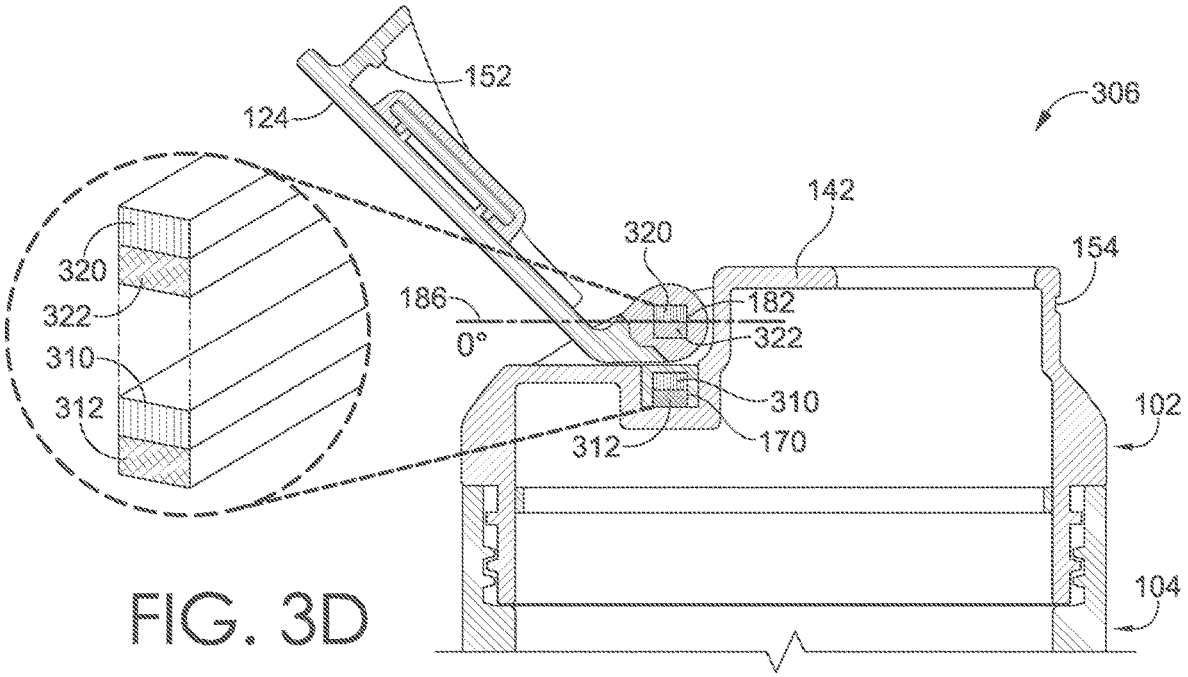
FIG. 3D depicts a cross-sectional view of the lid structure shown in FIG. 1C having the pivoting cap in the open position, in accordance with aspects herein.

Finally, as shown in the cross-sectional view 306 in FIG. 3D of the lid structure 102 with the pivoting cap 124 being in the final open position 196, the second magnet 182 located within the pivoting member 216 of the pivoting cap 124, is not rotated, or rotated 0° from the starting position (configuration of the first magnet 170) such that the positive magnetic pole segment 310 of the first magnet 170 is fully facing the negative magnetic pole segment 322 of the second magnet 182. Thus, as shown in the magnetic force field representation 404 shown in FIG. 4C, the attracting forces created by the negative magnetic pole segment 322 of the second magnet 182 and positive magnetic pole segment 310 of the first magnet 170 attract each other to a maximum extent. (Although 0° rotation from the starting position is depicted and described, it is contemplated that the rotation may be anywhere between and including 0° and 44° from the starting position, without departing from aspects herein.) This configuration forces the pivoting cap 124 to stay in the open position 196 regardless of the angle in which the lid structure 102 is turned. In other words, pivoting cap 124 stays in the open configuration regardless of whether the lid structure is right-side-up, up-side-down, or any position in between, which makes dispensing the beverage from the beverage system 100 easier and more convenient because the user does not have to worry about having to hold the pivoting cap 124 open by other means, such as, for example, using other fingers, or the other hand, while gripping the base structure 104 at the same time. Furthermore, in accordance with aspects herein, the attractive magnetic forces in the open position 196 between the first magnet 170 and the second magnet 182 are strong enough to maintain the pivoting cap 124 open, but are also weak enough that a user can easily push the pivoting cap 124 to transition the pivoting cap 124 to the closed position 198 with minimal effort.

Figure 5:
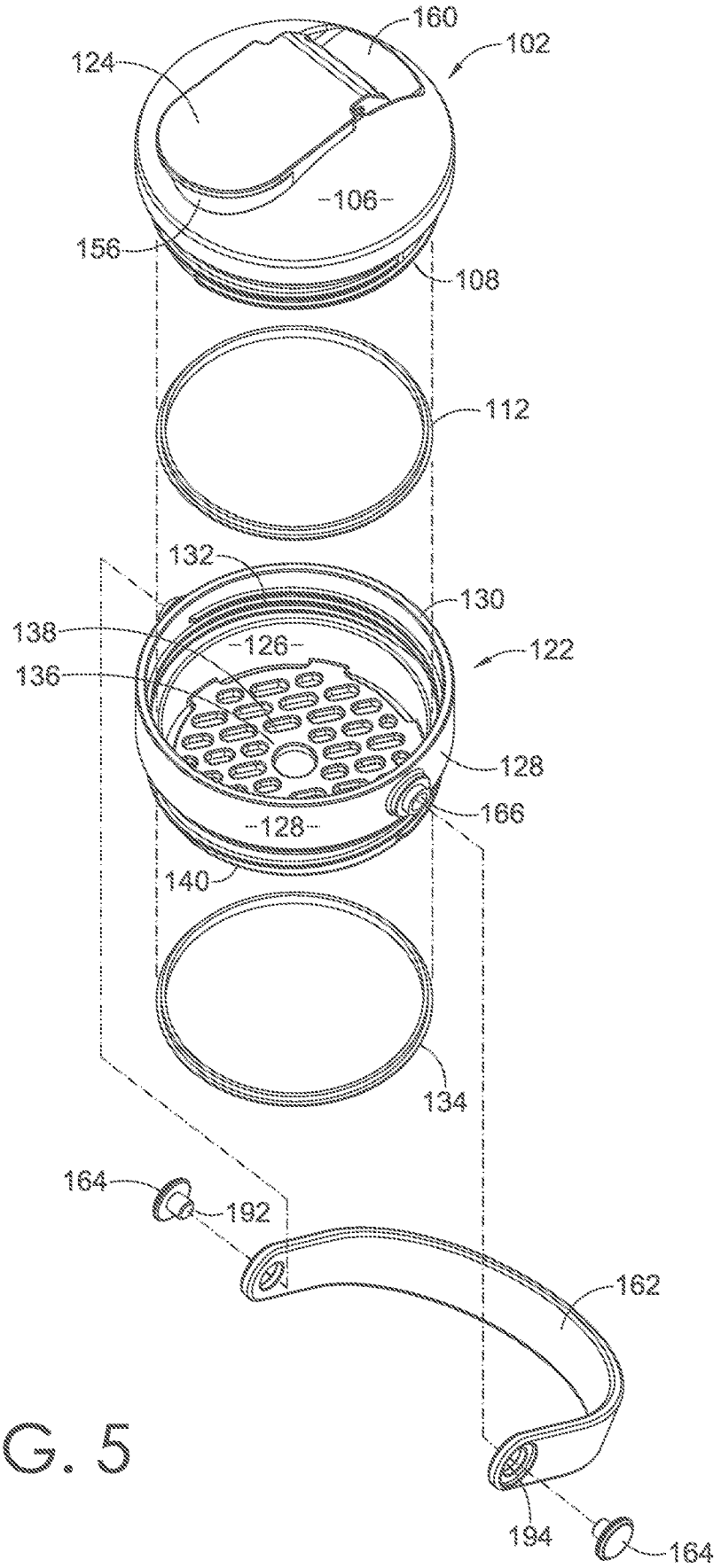
FIG. 5 depicts a perspective view of the shaker structure shown in FIG. 1B in a disassembled state, in accordance with aspects herein.

Moving on to FIG. 5, as described above, the beverage system 100 can be provided with a shaker structure 122. FIG. 5 shows a perspective deconstructed view that shows the shaker structure 122 in greater detail than that provided in FIG. 1B. As shown, the shaker structure 122 comprises a cup like or colander like shape having a body portion 128 and a second threaded engagement section 140. The body portion 128 comprises with an interior wall 126 and an exterior wall 127, where the interior wall 126 comprises a second threaded engagement section 132 proximate an opening edge 130. As described above, the second diameter 146 of the exterior wall 127 of the body portion 128 proximate the opening edge 130 corresponds to the first diameter 144 of the body portion 106 of the lid structure 102 and the third diameter 148 of the outer wall 116 of the base structure 104 proximate the opening edge 120. Thus, when all three components including the lid structure 102, the shaker structure 122, and the base structure 104 are assembled together, there is visual continuity, resulting in a sleek look for the beverage system 100.

As further shown in FIG. 5, the shaker structure 122 further comprises a second threaded engagement section 140 having a circumference and depth that is the same or comparable to the first threaded engagement section 108 of the lid structure 102 such that it can securely engage the first threaded portion 110 of the base structure 104. Further, the shaker structure 122 also comprises a second threaded engagement section 132 on the interior wall 126 proximate the opening edge 130 that is the same or comparable to the first threaded portion 110 of the base structure 104 such that it can securely engage the first threaded engagement section 108 of the lid structure 102. As also described above, in order to provide a seal between the lid structure 102, the shaker structure 122, and the base structure 104, first gasket 112 is provided for the lid structure 102 and second gasket 134 is provided for the shaker structure 122. The first gasket 112 seats in a recess (not shown) provided between the first threaded engagement section 108 and the body portion 106 of the lid structure 102, and second gasket 134 seats in a recess (not shown) provided between the second threaded engagement section 140 and the body portion 128 of the shaker structure. The second gasket 134 is configured to provide a seal between the shaker structure 122 and the base structure 104 when the shaker structure 122 and the base structure 104 are engaged with each other. Furthermore, the bottom 136 of the shaker structure 122 comprises a plurality of openings 138 that can be of different sizes that extend through the bottom 136. Thus, when assembled in the beverage system 100, when the beverage system 100 is shaken by a user, the contents of the beverage system are sifted through the plurality of openings 138, thereby breaking apart any clumps as the contents pass through the bottom 136 from the base structure 104 toward the lid structure 102, and back from the lid structure 102 to the base structure 104. The dome shape of the lid structure 102 may further aid in the mixing by reducing corners where, for example, powders may tend to clump and get stuck. Additionally, as described briefly above, the shaker structure 122 can also be used as an infuser by placing desired solid foods and/or ice within the base structure together with a liquid medium such that the shaker structure 122 acts as a sifter allowing the infused liquid medium to pass through the plurality of openings 138 but not the solid foods and/or ice. Alternatively, the solid foods and/or ice may be placed within the shaker structure 122 (i.e., cavity between the shaker structure and the lid structure) so that the liquid medium passes through the plurality of openings 138 and through the solid foods and/or ice, as the liquid medium is dispensed from the beverage system 100.

Figure 6A:
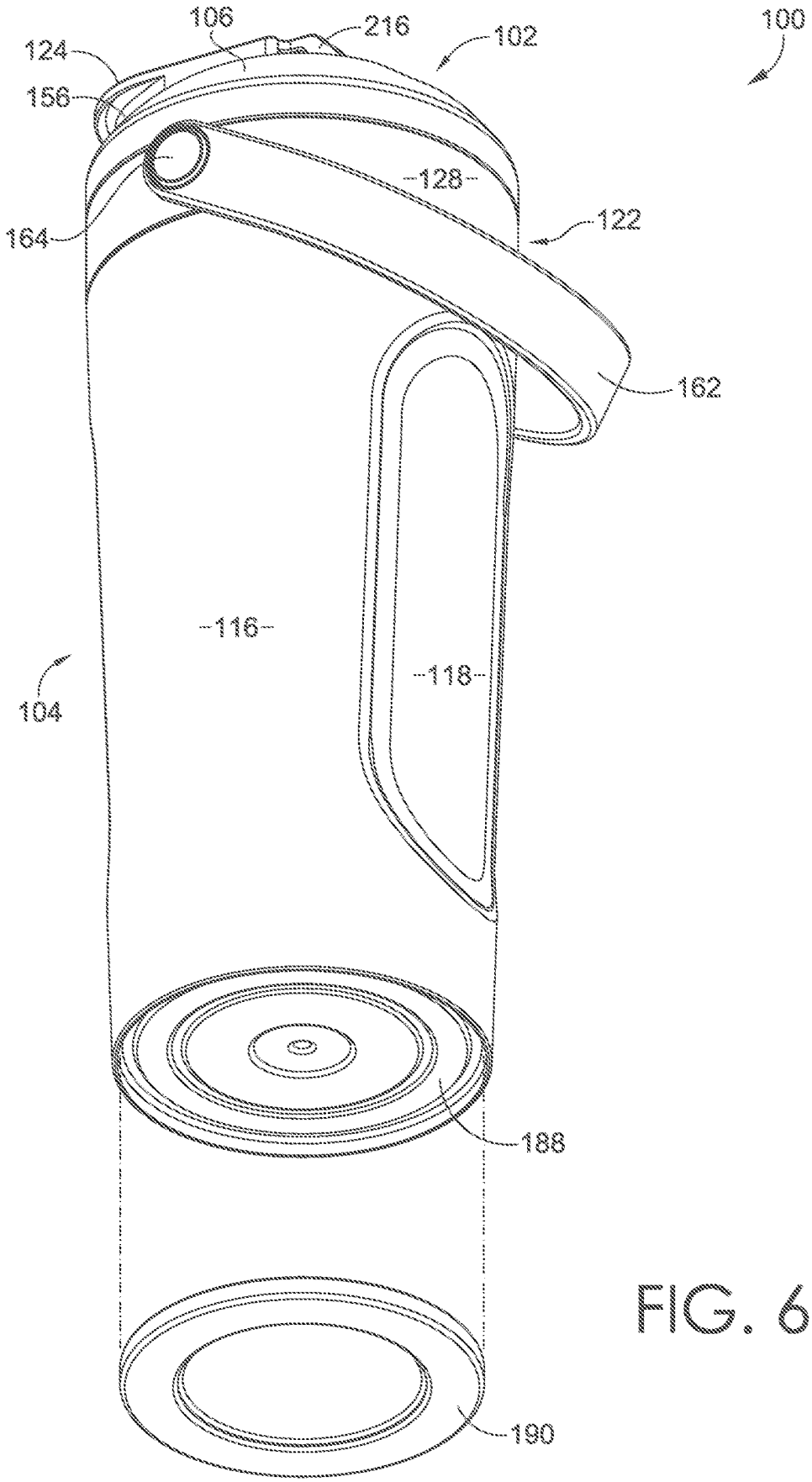
FIG. 6A depicts a bottom perspective view of the beverage system in FIG. 1A displaying a disassembled footing, in accordance with aspects herein.
Figure 6B:
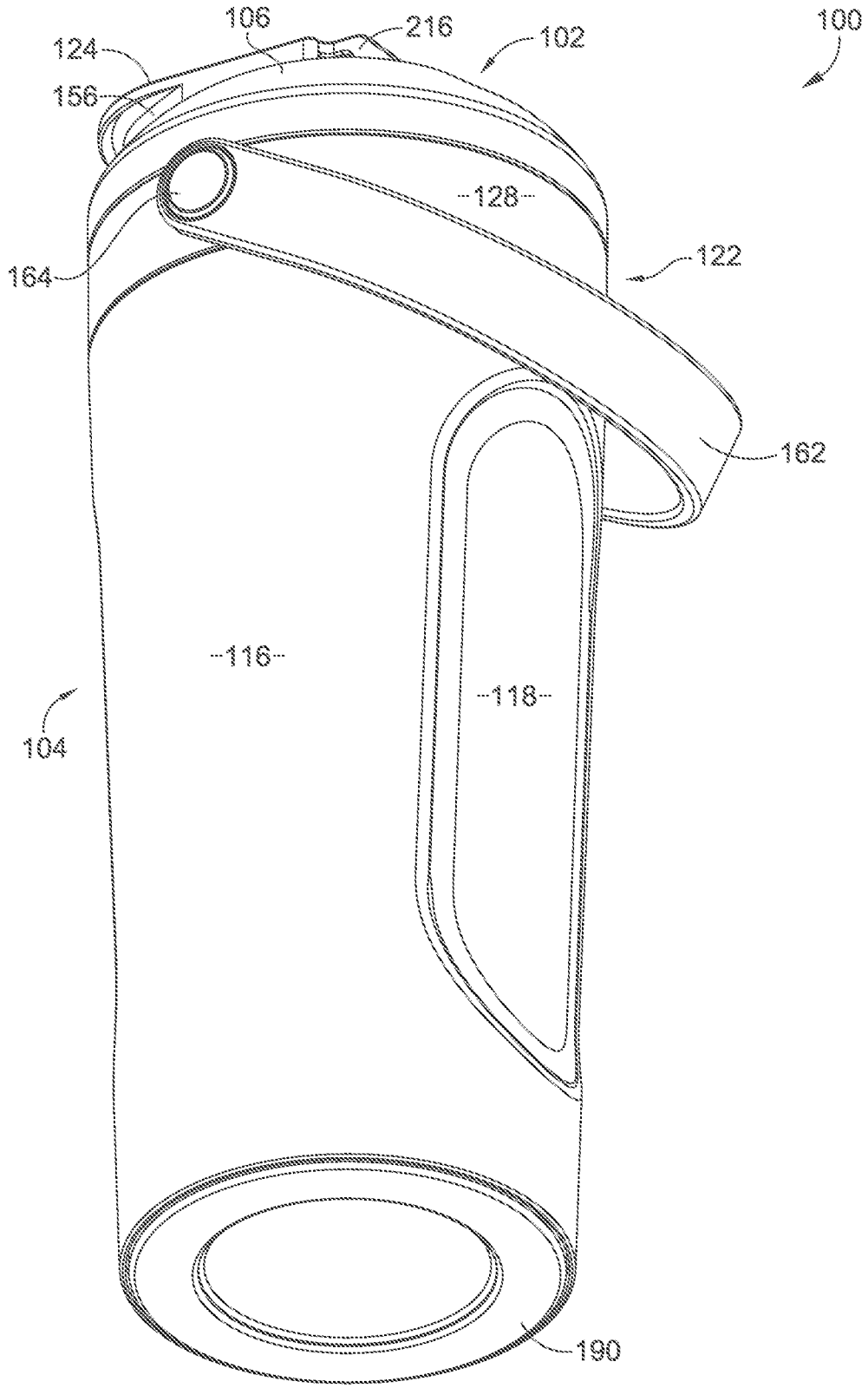
FIG. 6B depicts a bottom perspective view of the beverage system in FIG. 1A displaying a disassembled footing, in accordance with aspects herein.
Figure 7:
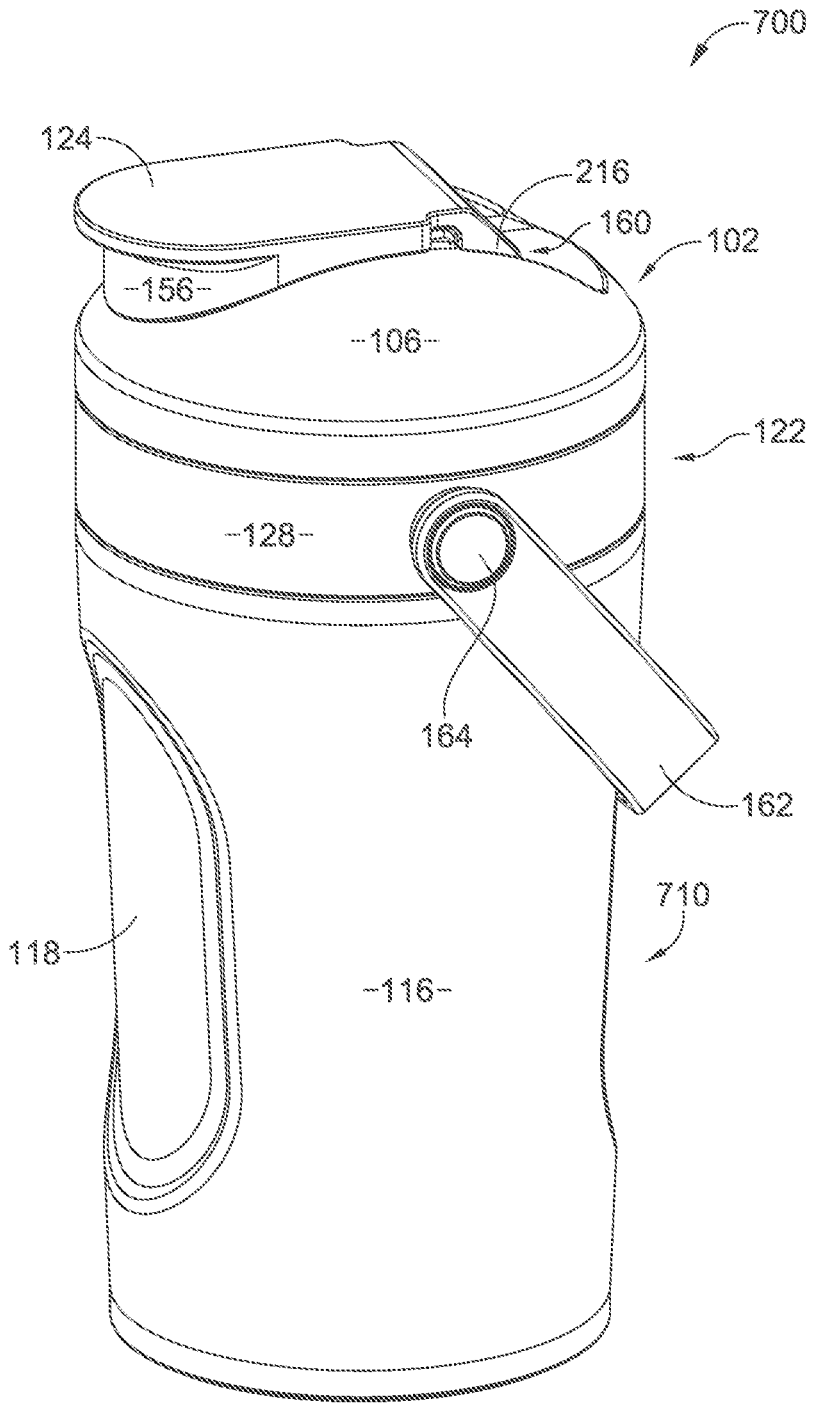
FIG. 7 depicts an alternative beverage system, in accordance with aspects herein.

Another advantageous aspect of the beverage system 100, as shown in FIGS. 6A and 6B in accordance with aspects herein is that the base structure may be provided with a footing 190 to the bottom 188 of the base structure 104 to, for example, make the bottom 188 have a non-slip surface. Thus, the footing 190 may be formed of a foam, sponge, or rubber material that is able to create a non-slip surface, such as, for example, thermoplastic polyurethane, urethane, silicone, latex, vinyl, and the like. Another advantage of the footing 190 may be that it may have a sound dampening effect, such that when the beverage system 100 is set down on a hard surface, it minimizes the contacting noise between the beverage system 100 and the hard surface. Further, it is also contemplated that differently sized base structures may be provided that can be used interchangeably with the lid structure 102 and/or the shaker structure 122, in accordance with aspects herein. For example, FIG. 7 shows a beverage system 700 having a smaller capacity base structure 710 than the base structure 104 of the beverage system 100, however, a base structure having a larger capacity than the base structure 104 is also contemplated. Thus, a user may be given the option to choose from a variety of capacities, and when more than one beverage system is accessible, the different components may be used interchangeably between systems. This is also advantageous on the production side of the beverage systems because the variation would be only in the manufacturing of the base structure to manufacture base structures with different capacities.

Additionally, although some exemplary implementations of the embodiments described herein are shown in the accompanying figures, these implementations are not intended to be limiting. Rather, it should be understood that the various embodiments and aspects described herein may be implemented upon any insulated container.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

What is claimed:

1. A lid structure for a beverage system comprising:

a body portion including a spout, a threaded engagement section, and a first cavity housing a first magnet, wherein the threaded engagement section is configured to engage a base structure of the beverage system; and a pivoting cap including a hood portion that interfaces with the spout of the body portion when the pivoting cap is in a closed position, and a pivoting member having a second cavity housing a second magnet, wherein the pivoting member is configured to pivotably engage the body portion proximate to the first cavity housing the first magnet such that the first magnet and the second magnet are in close proximity to each other, wherein the pivoting cap is configured to pivotably move from the closed position to an open position about an axis centered within the second cavity.

2. The lid structure of claim 1, wherein the first magnet comprises a first magnetic pole segment having a first polarity and an adjoining second magnetic segment comprising a second polarity that is opposite to the first polarity, and wherein the second magnet comprises a third magnetic segment comprising the first polarity and an adjoining fourth magnetic segment comprising the second polarity.

3. The lid structure of claim 2, wherein in the open position the first magnetic pole segment of the first magnet faces the fourth magnetic segment of the second magnet to a maximum extent.

4. The lid structure of claim 2, wherein in the closed position, the second magnet comprises a first rotated orientation with respect to the first magnet; and in the open position, the second magnet comprises a second rotated orientation with respect to the first magnet.

5. The lid structure of claim 4, wherein the first rotated orientation is between 100° and 180° rotation with respect to the first magnet.

6. The lid structure of claim 5, wherein the first rotated orientation is a 135° rotation with respect to the first magnet.

7. The lid structure of claim 4, wherein the second rotated orientation is between 0° and 44° with respect to the first magnet.

8. The lid structure of claim 7, wherein the second rotated orientation is 0° with respect to the first magnet.

9. The lid structure of claim 1, wherein in the closed position, a tab of the hood portion of the pivoting cap snaps into a recess of the spout to lock the pivoting cap in the closed position.

10. The lid structure of claim 1, the pivoting cap further comprising a gasket configured to seal an opening of the spout when the pivoting cap is in the closed position.

11. A beverage system comprising:

a base structure comprising a threaded portion proximate an opening edge of the base structure; and a lid structure comprising:

a body portion including a spout, a threaded engagement section configured to interface with the threaded portion of the base structure, and a first cavity housing a first magnet, wherein the threaded engagement section is configured to engage a base structure of the beverage system; and a pivoting cap including a hood portion that interfaces with the spout of the body portion when the pivoting cap is in a closed position, and a pivoting member having a second cavity housing a second magnet, wherein the pivoting member pivotably engages the body portion proximate to the first cavity housing the first magnet such that the first magnet and the second magnet are in close proximity to each other, wherein the pivoting cap is configured to pivotably move from the closed position to an open position about an axis that extends through the second cavity.

12. The beverage system of claim 11, wherein the first magnet comprises a first magnetic pole segment having a first polarity and an adjoining second magnetic segment comprising a second polarity that is opposite to the first polarity, and wherein the second magnet comprises a third magnetic segment comprising the first polarity and an adjoining fourth magnetic segment comprising the second polarity.

13. The beverage system of claim 12, wherein in the open position the first magnetic pole segment of the first magnet faces the fourth magnetic segment of the second magnet to a maximum extent.

14. The beverage system of claim 12, wherein in the closed position, the second magnet comprises a first rotated orientation with respect to the first magnet; and in the open position, the second magnet comprises a second rotated orientation with respect to the first magnet.

15. The beverage system of claim 14, wherein the first rotated orientation is between 100° and 180° rotation with respect to the first magnet.

16. The beverage system of claim 15, wherein the first rotated orientation is a 135° rotation with respect to the first magnet.

17. The beverage system of claim 14, wherein the second rotated orientation is between 0° and 44° with respect to the first magnet.

18. The beverage system of claim 17, wherein the second rotated orientation is 0° with respect to the first magnet.

19. The beverage system of claim 11, further comprising a shaker structure.

20. A magnetic spout closure system:

a body portion comprising a first cavity housing a first magnet; and a pivoting cap movable between a closed position and an open position, the pivoting cap comprising a pivoting member housing comprising a second magnet, wherein the pivoting cap is pivotably engaged with the body portion about an axis extending through the pivoting member housing such that the first magnet and the second magnet are in close proximity with each other and a first magnetic force field of the first magnet is influenced by a second magnetic force field of the second magnet and vice versa.

* * * * *